United States Patent [19]

Cote

[11] 4,345,408

[45] Aug. 24, 1982

[54] BUILDING STRUCTURE

[76] Inventor: Paul A. Cote, 504 Cambridge Bldg., 10024 Jasper Ave., Edmonton, Alberta, Canada, T5J 1R9

[21] Appl. No.: 173,287

[22] Filed: Jul. 29, 1980

[30] Foreign Application Priority Data

Jun. 10, 1980 [CA] Canada ..... 353835

[51] Int. Cl.[3] ..... E04H 1/02

[52] U.S. Cl. ..... 52/169.3; 52/236.3

[58] Field of Search ..... 52/608, 169.3, 236.3, 52/79.4, 574, 169.3, 236.3; 404/37, 41

[56] References Cited

U.S. PATENT DOCUMENTS

| | | | |
|---|---|---|---|
| 916,756 | 3/1909 | Mosstman et al. | 52/574 |
| 1,306,246 | 6/1919 | Bried | 52/608 |
| 2,769,211 | 11/1956 | Hewitt | 52/79.4 |
| 2,886,855 | 5/1959 | Petter | 52/79.4 |
| 3,417,526 | 12/1968 | Lawson | 52/169.3 |

FOREIGN PATENT DOCUMENTS

| | | | |
|---|---|---|---|
| 733301 | 5/1966 | Canada | 404/41 |
| 2290547 | 6/1976 | France | 52/574 |
| 201867 | 8/1923 | United Kingdom | 52/608 |

*Primary Examiner*—James L. Ridgill, Jr.
*Attorney, Agent, or Firm*—George H. Dunsmuir

[57] ABSTRACT

A building structure for use in row housing developments includes a plurality of individual dwellings, which, when viewed from above, define substantially equilateral triangles, the corners of which are truncated, the base of each triangular dwelling forming the front of the dwelling and opposing the base of each adjacent triangular dwelling.

8 Claims, 4 Drawing Figures

BUILDING STRUCTURE

BACKGROUND OF THE INVENTION

This invention relates to a building structure, and in particular to a building structure intended for use in so-called row housing projects.

With constantly rising construction material and land costs, there is a definite need (i) to make the best use of available construction materials, and (ii) to place the largest number of building units in the smallest possible area. At the same time, it is desirable and eminently sensible to make homes as aesthetically pleasing as possible, and at the very least, to create an illusion of spaciousness. When constructing interconnected single family dwellings or row houses, the usual practice is to make rectangular rows of narrow, rectangular single family units. As a result, each unit includes small front and back lawns, commonly referred to as "postage stamp" size lawns.

Solutions to the problem of housing design to maximize land use have been proposed, for example by U.S. Pat. No. 2,886,855, which issued to B. J. Petter on May 19, 1959. In accordance with the teachings of the Petter patent, polygonal units are formed by a plurality of contiguous hexagonal elements, and the units are interconnected with other units by common walls to form larger building structures. Obviously, such a structure is not entirely suitable for use in row housing, since the structure would do nothing to solve the problem described above.

The object of the present invention is to provide a solution to the problem of row housing, i.e., to provide a simple building structure, which makes maximum use of an elongated strip of land, and which, at the same time, is aesthetically pleasant.

BRIEF SUMMARY OF THE INVENTION

Accordingly, the present invention relates to a building structure comprising a plurality of contiguous, similar units defining a row of such units, each said unit being substantially triangular in plan, with the base of each triangular unit opposing the base of each adjacent triangular unit, each row including a pair of end units, each end unit having one free side and one side common to a contiguous unit; each side of any other unit in such row being common to a pair of contiguous units.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENTS

Figure 1:
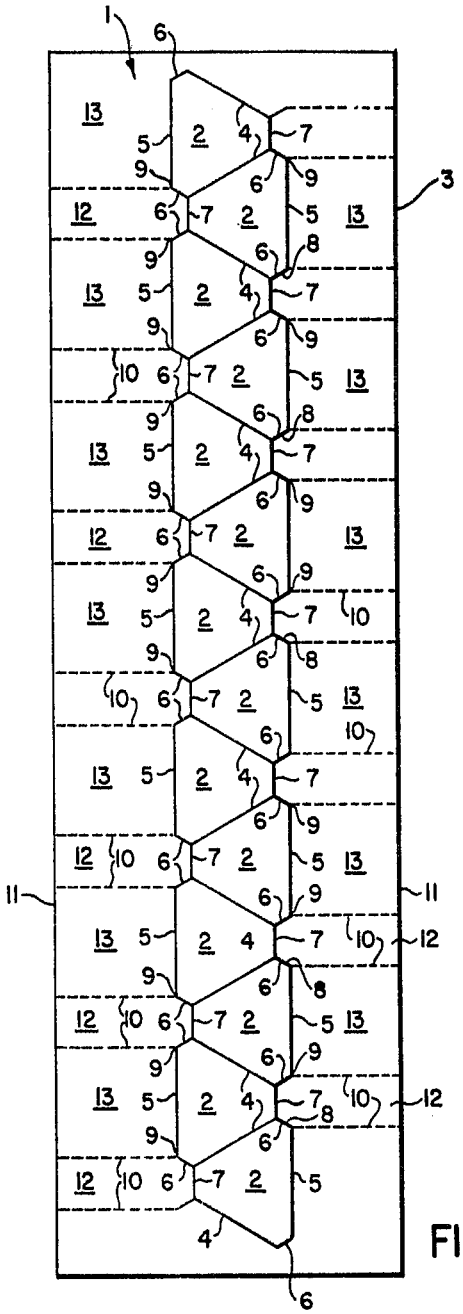
FIG. 1 is a schematic plan view of a building structure in accordance with the present invention.

Referring to FIG. 1 of the drawings, a building structure of the present invention generally indicated at 1 includes a plurality of contiguous units 2, which are arranged in a straight line on a rectangular piece of property or block 3. Each of the units 2 is substantially triangular in plan, i.e., when viewed from the periphery of each unit 2 defines a substantially triangular figure. In fact, the figure is an equilateral triangle.

For the sake of simplifying the description of the building structure, sides 4 of the units 2 which are common to adjacent units or which define the end wall of a row of units will be referred to as the sides of the triangular unit, and remaining side 5 of each unit which is aligned with sides 5 of each alternate unit will be referred to as the base of the triangle defined by the unit.

It will be noted that each corner 6 at the ends of the base 5 of each triangular unit 2 is truncated. Moreover, corners 7 opposite the bases 5 are truncated to a greater extent than the two remaining corners 6 of the units. Thus, the corners 7 and the truncated corners 6 of adjacent units create a large U-shaped recess 8 in the rear of each unit. The recess 8 can define the entrance to an underground garage. Each outer edge of corner 9 of the recess 8 defines one end of a lot line between two adjacent units 2, i.e., a line 10 drawn from the corner 9 at the end of each base 5 perpendicular to side edge 11 of the rectangular block 3 defines one side of backyard or driveway 12 of one unit 2 and one side of front yard 13 of an adjacent unit 2. Of course, the front and rear yards of the end units 2 are different from the front and rear yards of the remaining units.

While an elongated row of units 2 has been illustrated, it will be appreciated that the row defined by the units 2 can consist of two or more units. Moreover, the same system can be used on an arcuate strip of land, i.e., the row defined by the units 2 need not define a straight line. Of course, with an arcuate strip of land, in most cases, it would be necessary to change the dimensions and/or the shape of the basic truncated triangular units 2 and/or the property allotted to the individual units 2.

Figure 2A:
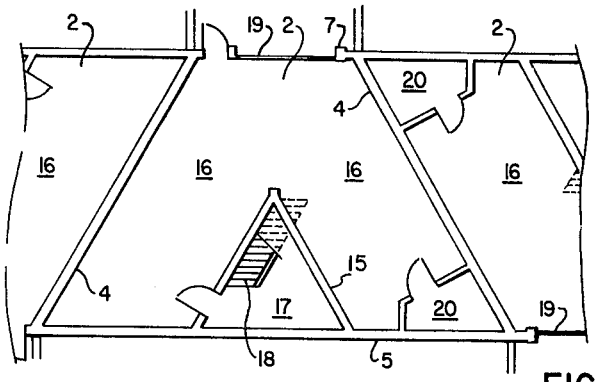
FIGS. 2A to 2C are schematic plan views of the basement, ground floor and second floor, in that order, of a typical housing unit in accordance with the present invention, on a larger scale than FIG. 1.
Figure 2B:
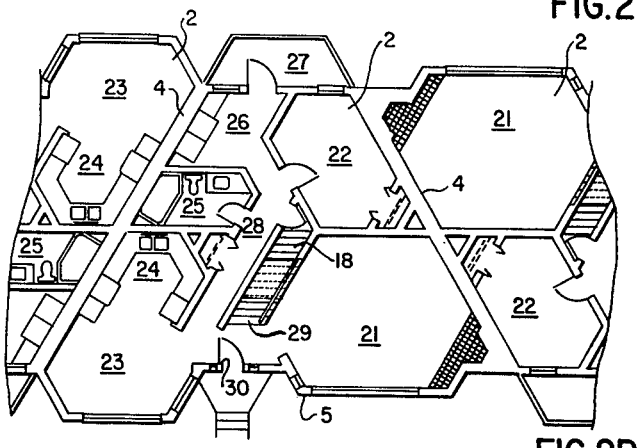
Figure 2C:
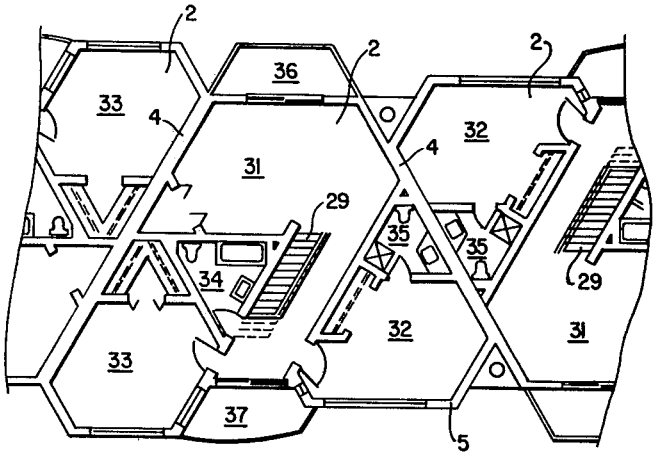

Reference is made to FIGS. 2A to 2C which illustrate one possible floor plan of a unit 2 constructed in accordance with the present invention. In order to avoid confusion, with few exceptions, a new set of reference numerals is used in FIGS. 2A to 2C.

The basement (FIG. 2A) of each unit 2 is defined by outside wall 5 (the base of the triangle) and side walls 4 (the sides of the triangle). In making the basement, there is no need to complicate the construction of forms by truncating all corners of the triangle. As illustrated in FIGS. 2B and 2C, the truncated corners are found above grade, i.e., on the ground and second floors of the building. A V-shaped supporting wall 15 is provided in the basement of FIG. 2A, such wall dividing the basement into parking areas 16 and an area 17 for stairs 18 and storage. A below grade garage door 19 is provided in the rear wall (truncated corner 7) of the unit 2, and a furnace room 20 is provided in one front corner. The ground or first floor (FIG. 2B) of the unit 2 is divided into a living room 21 and a bedroom 22 on one side, and a dining room 23, kitchen 24, bathroom 25 and utility room 26 on the other side of centre. A balcony 27 extends outwardly over the entrance to the basement garage. Access to the basement stairs 18 is gained through a centre hall 28, and stairs 29 to the second floor are above the basement stairs 18 and opposite front door 30.

The second floor (FIG. 2C) of the unit 2 is divided into a family room 31, bedrooms 32 and 33, and bathrooms 34 and 35. A second balcony 36 is provided above the first balcony 27, and a third balcony 37 is provided at the front of the building above the front door 30.

It will be appreciated that the foregoing description and FIGS. 2A to 2C relate to one of many possible internal subdivisions of the units 2. While the basement walls would not extend into the ground and second floors of the building, the same reference numerals have been used to identify the outside walls of all three levels of the unit in FIGS. 1, and 2A to 2C, so that the central unit 2 of FIGS. 2A to 2C can readily be related to the units 2 of FIG. 1. Moreover, the design of the roof of each unit 2 has purposely been omitted, because such design does not constitute part of the invention described herein.

With the building structure described hereinbefore, a greater number of units can be placed on a given piece of land than with conventional rectangular structure. The occupants of each unit are provided with one large front lawn area, rather than small areas at the front and back of the dwelling. In cases where two or more parallel blocks of the units are constructed, the units in one block are staggered with respect to the units in the next block, so that the front door of one unit is opposite the driveway or back of an opposing unit, thus ensuring maximum privacy. By alternating units, i.e., by making the building with the wide front end of one unit opposing the front end of any adjacent unit, the driveway of a central unit forms a wide separation between the front lawns of the units adjacent to such central unit.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example, equivalent elements may be substituted for those illustrated and described herein, parts may be used independently of the use of other features, all as will be apparent to one skilled in the art after having the benefits of the description of the invention.

What I claim is:

1. A row house structure habitable by humans, comprising a plurality of contiguous similar housing units defining a row of such units, at least two contiguous units being generally similarly triangular in plan, with the base of one triangular unit facing oppositely from the base of the other triangular unit and the two contiguous triangular units having a contiguous side, said row including a pair of end units, each end unit having one free side and a side contiguous with an adjacent unit, each side of any other unit in said row being contiguous with a side of an adjacent unit, and at least one access door in each housing unit.

2. A row house structure as claimed in claim 1, wherein at least some of said units are of plural story construction so as to have habitable areas on each floor, different floors of each plural story unit being interconnected by interior stairways.

3. A row house structure as claimed in claim 1 wherein said contiguous triangular units are truncated at least at their corners opposite their bases such that the bases form relatively wide front walls and the truncated portions define relatively narrow rear walls.

4. A row house structure as claimed in claim 3 wherein said contiguous triangular units each include a basement which is at least partially subgrade and a first floor level above said basement, each said first floor level being truncated at its other corners also, but to a lesser extent than the corner opposite its base, and each said basement being truncated only at its corner opposite its base.

5. A row house structure as claimed in claim 3 wherein said generally similar triangular units are generally equilateral triangles in plan, apart from any truncated corners.

6. A row house structure as claimed in claim 3 wherein all units in said row are generally similarly triangular in plan and are located on a surveyed plot of land with lot boundary lines, the front lot boundary lines for each unit extending outwardly from and generally normal to its base at the ends thereof, the front lot lines of adjacent units extending substantially oppositely and defining rear lot lines for their adjacent units, the front lot lines of each unit being thus substantially more widely spaced than its rear lot lines.

7. A row house structure as claimed in claim 6 wherein said contiguous triangular units are truncated at their other corners also, but to a lesser extent than the corners opposite their bases.

8. A row house structure as claimed in claim 7 wherein at least successively contiguous units are generally similarly triangular in plan and similarly truncated at their corners, the base of the center unit of the three facing oppositely from the bases of the other two, adjacent truncated corners of the three units adjoining so as to define a generally U-shaped recess outwardly of the center unit, the base of which is defined by the truncated corner of the center unit opposite its base, and the sides of which are defined by truncated corners of the adjacent two units.

* * * * *